United States Patent [19]

Thompson et al.

[11] 4,151,013

[45] Apr. 24, 1979

[54] ALUMINUM-MAGNESIUM ALLOYS SHEET EXHIBITING IMPROVED PROPERTIES FOR FORMING AND METHOD ASPECTS OF PRODUCING SUCH SHEET

[75] Inventors: David S. Thompson; John S. Prestley, Jr.; Thomas E. Webb, all of Richmond, Va.

[73] Assignee: Reynolds Metals Company, Richmond, Va.

[21] Appl. No.: 876,577

[22] Filed: Feb. 10, 1978

Related U.S. Application Data

[63] Continuation of Ser. No. 812,818, Jul. 5, 1977, abandoned, which is a continuation-in-part of Ser. No. 746,168, Nov. 30, 1976, abandoned, which is a continuation of Ser. No. 624,612, Oct. 22, 1975, , abandoned.

[51] Int. Cl.[2] ..... C22F 1/04

[52] U.S. Cl. ..... 148/11.5 A; 148/32

[58] Field of Search ..... 148/11.5 A, 12.7, 32

[56] References Cited

U.S. PATENT DOCUMENTS

| | | | |
|---|---|---|---|
| 3,346,371 | 10/1967 | Jagaciak | 148/11.5 A |
| 3,392,062 | 7/1968 | Altenpohl et al. | 148/11.5 A |
| 3,661,657 | 5/1972 | Wong | 148/11.5 A |
| 3,708,352 | 1/1973 | Brown et al. | 148/11.5 A |
| 3,761,322 | 9/1973 | Winter et al. | 148/11.5 A |

FOREIGN PATENT DOCUMENTS 706854 0000 Canada.

OTHER PUBLICATIONS

Phillips, V. A., "Stretcher-Strain Markings in Aluminum Alloys", Sheet Metal Industries, Nov. 1953, pp. 977-985.

Phillips, V. A., "Stretcher-Strain Markings in Aluminum Alloys", Sheet Metal Industries, Dec. 1953, pp. 1048-1054.

Phillips, V. A. et al., "Yielding Behavior and Pressing Properties of Aluminum-Magnesium Alloys", Journal of the Institute of Metals, 1952-1953, vol. 81, pp. 625-647.

Wright, J. C. et al., "Yielding Behavior and Pressing Properties of Aluminum-Magnesium Alloy Sheet", Journal of the Institute of Metals, 1961-1962, vol. 90, pp. 369-374.

Borchers, H. et al., "Yield Point Behavior of Aluminum and Aluminum-Magnesium Alloys at Different Structure States and Temperatures", Aluminum; Jan. 1968, vol. 44, pp. 47-51.

Aoki, I. et al., On Elimination Method of Yield Point Phenomena in Aluminum-Magnesium Alloy Sheets—Study on Aluminum-Magnesium Alloy Sheets (1st Report), Journal of the Light Metals Institute of Japan, 1972, vol. 22, No. 6, pp. 377-385.

Rossig, H. H. et al., "Yield Phenomena in Polycrystalline Aluminum-Magnesium Alloys, Part I", Metal, Mar. 1974, vol. 28, No. 3, pp. 232-237.

*Primary Examiner*—W. Stallard

*Attorney, Agent, or Firm*—Glenn, Lyne, Girard, Clark and McDonald

[57] ABSTRACT

Described is Al-Mg Sheet, in annealed condition, which has good formability and is further characterized structurally by its ability to be formed in the manufacture of sheet-metal products without being marked by Type A Luder lines. Also described are method aspects of producing such sheet, including the steps of selectively annealing and quenching followed by stretching.

14 Claims, No Drawings

ALUMINUM-MAGNESIUM ALLOYS SHEET EXHIBITING IMPROVED PROPERTIES FOR FORMING AND METHOD ASPECTS OF PRODUCING SUCH SHEET

This application is a continuation of now abandoned Application Ser. No. 812,818, filed July 5, 1977, which was a continuation-in-part of now abandoned Application Ser. No. 746,168, filed Nov. 30, 1976, which in turn was a continuation of now abandoned Application Ser. No. 624,612, filed October 22, 1975.

BACKGROUND OF THE INVENTION

This invention relates to sheet and sheet-metal products, including exterior automotive body components, such as fenders or the like, made of non-heat-treatable aluminum alloys, particularly alloys in the 5000 Series (Aluminum Association designation) which consist essentially of aluminum and about 2–8% magnesium by weight.

It is well recognized that magnesium-containing aluminum alloys in the 5000 Series have good formability in an annealed condition but their use in the manufacture of sheet-metal products has been limited due to objectionable strain-induced marks or imperfections which develop on the surface of the sheet during forming. These marks, otherwise known as "Luder lines" or "stretcher-strains", can be so pronounced as to be visible even when the surface of a sheet-metal product is painted.

Generally, there are two varieties of Luder lines which may be of concern. These are sometimes respectively designated as "Type A" and "Type B" lines. Type A lines refer to random, wedge-shaped markings developed at low levels of strain, often as little as about ¼ percent, while Type B lines refer to parallel ripples that occur at somewhat higher levels of strain such as about 2 percent.

At levels of strain of about 1.5 to 2.5 percent, Type A lines tend to disappear. Under laboratory conditions, when sample strips are slowly stretched in a tensile test machine, disappearance of Type A lines typically coincides with the onset of Type B lines.

In actual practice Type B lines rarely present a problem to the manufacturer. The formation of Type B lines is suppressed, for example, where the forming of the sheet is carried out with sufficient speed. Type B lines may also be avoided at relatively slow forming speeds under certain biaxial strain conditions.

Type A lines, however, are not so readily controlled as Type B lines and tensile test machine results are fairly indicative of what can be expected in practice.

Several ways to counteract the tendency of Al-Mg alloys sheet to display Type A Luder lines have been heretofore described in the literature, but it does not appear that any of these have been carried out commercially.

In accordance with one approach to the problem, the grain size in the metal is carefully controlled to a relatively coarse 0.04 to 0.06 mm by means of a substantial variation in conventional mill practices. In making sheet of 1/32 to 1/16 inch finished thickness, for example, the metal is conventionally hot rolled to a convenient reroll gauge such as about 0.10 to 0.25 inch in thickness, sometimes being followed by an intermediate annealing operation, after which it is cold rolled from the reroll gauge to the finished thickness. This cold rolling operation effects at least a 40 percent and often as much as 60 to 80 percent reduction in thickness, and consequently work hardens the material appreciably. To restore formability, the metal is given a recrystalizing anneal by heating within the range of 650° to 950° F.

In order to achieve the 0.04 to 0.06 mm grain sizes, however, it is necessary to perform the cold rolling operation in successive stages interrupted by still additional intermediate annealing operations. This of course complicates production practices and involves substantial added expense. A further disadvantage to the approach is that if grain size becomes as coarse as about 0.07 mm or more, an objectionable roughening of the metal surface, known as "orange peel", can result.

A second recognized method for dealing with the problem of Type A lines involves conducting the usual annealing step at a temperature of about 930° F. (although some have reported good results at temperatures as low as 572° F.), then quenching the metal in water, preferably cold water, and finally lightly rolling or roller-leveling so as to flatten the sheet without materially pre-straining it. Drawbacks to this method include the higher energy requirements and inflexibility of being forced to anneal at the higher end of the temperature scale. It is also significant to note that on being aged, metal treated by this method is reported to revert to its tendency to show Type A lines when formed.

According to another approach, the metal is pre-strained by following a conventional anneal with: (1) a cold rolling pass to effect a thickness reduction of about 5 to 10 percent, (2) a heavy roller-leveling operation, or (3) a stretching of the sheet to effect a permanent set of about 1½% or more. Nominal cold rolling has been proven to be impractical for execution on a commercial scale, however, since the precise degree of work put in is not readily susceptible to control and the properties of the metal can be expected to differ considerably with slight variations in sheet gauge. And with each of the three stated modes of pre-straining, a substantial loss of ductility has been a recognized disadvantage.

To obviate the loss of ductility accompanying the immediately preceding approach, in accordance with still another proposal, cold rolling or roller-leveling would be followed by a non-recrystalizing anneal. In carrying out such a procedure, however, experience has shown that the properties of the metal are unduly sensitive to time and temperature, and are thus most difficult to control. Furthermore, the need for an added annealing operation is an obvious drawback involving time and energy.

SUMMARY OF THE INVENTION

In accordance with this invention, it has been discovered that several commercially significant factors have apparently been heretofore overlooked. First, to be effective in terms of achieving both good formability and a disinclination toward showing Type A Luder lines in Al-Mg sheet, the time and temperature on annealing can be surprisingly brief, such as only a minute or two. Second, it has been found that when the appropriate annealing of such sheet is followed by a slight stretching of the sheet, such as on the order of about 0.5 percent, good formability free from Type A lines can consistently be obtained. Third, when the metal is stretched as just described, it has been found that annealing may entail temperatures significantly lower than 930° F. and quench rates slower than would correspond to a quench in cold water.

These discoveries have opened the door to the use of high-speed, continuous heat-treating equipment of greatly improved efficiency and reduced cost of operation have given rise to a consistency of results that make the commercial production of highly formable Al-Mg sheet which forms free from Type A Luder lines now practical. A further and rather unexpected advantage of this invention is the fact that the properties of Al-Mg sheet produced in accordance therewith tend to remain stable even when the sheet is subjected to prolonged aging at elevated temperatures.

The practice of this invention, which as mentioned is applicable to sheet of alloys consisting essentially of aluminum and 2–8% magnesium by weight, provides for the heating of the sheet, in its substantially finished gauge, to a temperature T in the range of from about 850° F. to about 1050° F., quenching the sheet down to about 350° F. or less at a rate according to how the sheet was heated, and then uniformly stretching the sheet to effect a permanent set from about 0.25% to about 1%, preferably about 0.5%.

On heating the sheet, as has been mentioned, a surprisingly brief time at temperature, such as less than about one-half a minute, is sufficient for both the purposes of annealing and preparing the sheet for subsequent forming free from Type A lines. Consequently, the heating of the sheet as contemplated herein is particularly suited to be carried out on continuous heat-treating equipment wherein the sheet, moving at line speeds from about 50–400 feet per minute, is passed through a continuous heating zone, with a residence time of less than ten minutes, such as about one-half minute to five minutes.

To avoid setting up adverse strains in the sheet, the quench rate used should be as low as possible consistent with obtaining the desired results. Specifically, quenching as provided for by this invention is at rates of about or less than that corresponding to a quench in cold water (about 9,000° F. per second) and most preferably, where the sheet is subsequently uniformally stretched to effect a permanent set along its length of about 0.5%, quenching will be at a rate close to the minimum rate Q which depends upon the previously mentioned temperature T to which the sheet has been heated, as set forth in the following equation:

$$\text{Log}_{10}(Q)=2.785-0.030657(T-900)+0.00053144(T-900)^2-0.0000074631(T-900)^3,$$

where Q is in ° F./Sec and T is in ° F.

Quenching can be carried out in a continuous in line operation by any suitable technique, such as by fan cooling or by spraying with an aqueous coolant.

The uniform stretching of the sheet may be conveniently carried out continuously at ambient temperatures by stretch levelling equipment which also serves to flatten the sheet and thereby remove any distortions present following the heating and quenching operations.

The foregoing, as well as other features hereinafter described greater detail, constitute the principal distinctions over the less advantageous practices heretofore known, as previously discussed.

DESCRIPTION OF PREFERRED EMBODIMENTS

As noted generally above, this invention is concerned with improved techniques effective to avoid Type A markings in forming sheet metal products from alloys consisting essentially of aluminum and about 3 to 6% magnesium by weight, primarily by following the substantial cold rolling of the sheet with heating, quenching, and uniform stretching operations.

For present purposes, reference to alloys which consist essentially of aluminum and about 2 to 8% magnesium by weight should be taken to include the regular wrought alloys of the 5000 Series wherein the magnesium content is within the stated limits. Such alloys may contain, for example, incidental impurities and minor additional elements, usually not exceeding about 1% in the aggregate, including silicon up to about 0.4% iron up to about 0.5%, copper up to about 0.3%, manganese up to about 0.5%, chromium up to about 0.3%, titanium up to about 0.2% and zinc up to about 0.25% by weight.

An alloy to which the practice of this invention has been found to be particularly suited, and which has further been found to have ideal characteristics for use in making sheet metal products, is Alloy 5182 (Aluminum Association designation). The registered composition limits for this alloy are: up to 0.20% silicon, up to 0.35% iron, up to 0.15% copper, 0.20–0.50% manganese, 4.0–5.0% magnesium, up to 0.10% chromium, up to 0.25% zinc, up to 0.10% titanium, and other elements not exceeding 0.05% each and 0.15% total, balance aluminum.

Cold rolled sheet of 1/32 to 1/16 inch finished thickness suitable for processing by the methods of this invention can be prepared in accordance with conventional commercial techniques. The metal, for example, can be cast into ingot form and then preheated for hot rolling to a convenient reroll gauge of about 0.10 to 0.25 inch in thickness. By way of illustration, the preheating of the metal may be at temperatures in the range of 975° to 1075° F. and the time at temperature for the preheating may be at from about 5 to 20 hours. The metal may be hot rolled immediately upon the conclusion of the preheating, or it may be allowed to first cool somewhat and then be reheated at a temperature of about 900 % F. Upon completion of the hot rolling, the metal may be cold rolled directly to its substantially finished sheet thickness, or it may first be subjected to an intermediate anneal by heating the metal, for example, for about 2 hours at 600° to 650° F. When the methods in accordance with this invention are followed, however, the need for further intermediate annealing during the course cold rolling is eliminated. In cold rolling the sheet to its finished gauge, the reduction in thickness should be at least about 40%, and will often be as much as about 60 to 80%.

In accordance with a preferred embodiment of this invention, the method comprises continuously making cold rolled sheet as described above, passing the sheet through an elevated temperature heating zone, at a rate of about 50 to 400 feet per minute, to heat the moving sheet to a temperature T in the range of about 900° to 950° F. for a period of about ½ to 5 minutes, spray quenching the heated sheet with an aqueous coolant as it leaves the heating zone to effect a quenching of the sheet at a rate of about Q, where $$\text{Log}_{10}(Q)=2.785-0.030657(T-900)+0.00053144(T-900)^2-0.0000074631(T-900)^3,$$

where Q is in ° F. per second and T is in ° F., and then uniformally stretching the cooled sheet at substantially ambient temperature to effect a permanent set of about 0.5%.

The heating of the cold rolled sheet is preferably carried out in a conventional continuous heat treating furnace of the type commonly used for the solution heat treatment of the so-called heat treatable aluminum base alloys, although it may be noted in passing that alloys in the 5000 Series, such as Alloy 5182, are classified as non-heat treatable, i.e. they are non susceptable to appreciable strengthening by natural or artificial aging after prolonged heating at high temperatures and quenching.

The uniform stretching of the first heated and then quenched sheet as required in this invention, is preferably carried out continuously with conventional stretch levelling equipment, such as is commonly used in connection with the continuous heat treating and processing of heat treatable alloys. Satisfactory results have been obtained, for example, using the "Dimension IV" Levelling Processor manufactured by Herr Equipment Corporation (now Herr-Voss Corporation, Callery, Pa.). This machine was equipped to handle sheet from 30" to 72" in width and from 0.010 to 0.125" in thickness at line speeds of from 50 to 240 feet per minute.

The following examples, which are not to be regarded as limiting, are based on presently preferred practices of this invention:

EXAMPLES

EXAMPLE NO. 1

5182 Alloy was semi-continuously cast into an ingot of 24×64" in cross-section prior to rolling and the ingot was preheated for 5.5 hours between 1000° and 1075° F. The ingot was then rolled on a continuous hot line to a thickness of 0.150". Cold Rolling consisted of successive reductions to 0.097", 0.070" and finally 0.05" in thickness. The cold rolled sheet was subjected to a continuous heating operation in which it was passed at a rate of about 200 feet per minute through a heating zone of about 930° F. in temperature. The residence time in a heating zone was approximately 3 minutes. On emerging from the zone, the sheet was rapidly cooled in a fog-spray quench system at a rate of about 9,000° F. per second. After quenching, the sheet entered a stretch leveller which was set to uniformly impart a permanent set along its length of about 0.5% along the length of the sheet. A 1"×8" strip of the sheet thus produced was stretched in a tensile test machine and no evidence of Type A Luder lines was seen. The load-deflection curves obtained from the testing were substantially free of any plateau, thus further indicating the abscence of a tendency for Type A lines to form.

EXAMPLE NO. 2

5182 Alloy was processed as in Example No. 1, but with a preheat of 19 hours at 975° to 1025° F. and a reheat of 900° F., and with hot rolling to a reroll gauge of about 0.156". Cold rolling was carried out in a tandem mill to 0.101" and then 0.070". After an intermediate anneal of about 2 hours at 620° to 650° F. the sheet was cold rolled to a finished thickness of about 0.033". The final heat treat, quench and stretch were the same of those of Example No. 1. The sheet thus produced was tested as in Example No. 1 and neither Type A lines nor a telltale plateau in the load-deflection curve was seen.

EXAMPLE NO. 3

Conventionally produced 0.040" thick 5182-F sheet was subjected to the final thermal cycle, quench and stretch of Example No. 1. The sheet thus produced was tested as in Example No. 1 and neither Type A lines nor a telltale plateau in the load-deflection curve was seen.

EXAMPLE NO. 4

Six samples of sheet prepared in accordance with Example No. 1 were aged by respectively subjecting them to temperatures of 120°, 150°, 180°, and 212° F. for a period of one year, and to temperatures of 240°, and 300° F. for a period of three months. Each of the samples thus produced was tested as in Example No. 1 and neither Type A lines nor a telltale plateau in the load-deflection curve was seen.

EXAMPLE NO. 5

Six samples of sheet prepared in accordance with Example No. 2 were aged by respectively subjecting them to temperatures of 120°, 150°, 180° and 212° F. for a period of one year and to temperatures of 240° and 300° F. for a period of three months. Each of the samples thus produced was tested as in Example No. 1 and neither Type A lines nor a telltale plateau in the load-deflection curve was seen.

EXAMPLE NO. 6

Six samples of sheet prepared in accordance with Example No. 3 were aged respectively subjecting them to temperatures of 120°, 150°, 180° and 212° F. for a period of one year and to temperatures of 240° and 300° F. for a period of three months. Each of the samples thus produced was tested as in Example No. 1 and neither Type A lines nor a telltale plateau in the load-deflection curve was seen.

EXAMPLE NO. 7

5182 Alloy was hot rolled to a reroll gauge of 0.135" and then cold rolled without intermediate anneal to a finish sheet thickness of 0.040". The cold rolled sheet was then heated, quenched and stretched as in Example No. 1 except that the temperature of the heat treatment was reduced to about 900° F. The sheet thus produced was tested as in Example No. 1 and neither Type A lines nor a telltale plateau in the load-deflection curve was seen.

EXAMPLE NO. 8

5182 Alloy was processed as in Example No. 7 except that the temperature for the heat treatment was further reduced to 850° F. The sheet thus produced was tested as in Example No. 1 and both a hint of Type A lines and a slight plateau in the load-deflection curve were seen.

EXAMPLE NO. 9

5182 Alloy was processed as in Example No. 8 except that the temperature for the heat treatment was 900° F. and the quench rate was about 90° per second. The sheet thus produced was tested as in Example No. 1 and a hint of Luder lines, which could have been Type B lines, was seen.

EXAMPLE NO. 10

5182 Alloy was processed as in Example No. 9 except that the temperature for the heat treatment was about 950° F. The sheet thus produced was tested as in Example No. 1 and a hint of Luder lines, which were felt to probably be Type B lines, was seen.

EXAMPLE NO. 11

5182 Alloy was processed as in Example No. 1 except that no stretch was imparted. The sheet thus produced was tested as in Example No. 1 and both Type A lines and a plateau in the load-deflection curve were seen.

EXAMPLE NO. 12

5182 Alloy was processed as in Example No. 11 except that the temperature for the heat treatment was about 950° F. The sheet thus produced was tested as in Example No. 1 and a hint of Luder lines, which could have been Type B lines, was seen.

EXAMPLE NO. 13

5182 Alloy was processed as in Example No. 10 except that no stretch was imparted. The sheet thus produced was tested as in Example No. 1 and both Type A lines and a plateau in the load-deflection curve were seen.

What is claimed is:

1. In processing cold rolled, work-hardened sheet, said sheet being further characterized by its alloy composition consisting essentially of aluminum and from about 2 to about 8% magnesium by weight and by its work-hardened state corresponding to having been cold rolled to effect a thickness reduction of at least 40%, the method of rendering said sheet in a highly formable finished condition wherein the finished sheet will form free from Type A Luder lines when strained from about ¼% to about 2.5%, which comprises the following steps:

heating said sheet to a temperature T in the range of from about 850° F. to about 1050° F; then quenching said sheet down to about 350° F. in temperature at a rate of at least about Q, and at most about 9000° F./Second, where Q is ascertained according to the following equation:

$$\text{Log}_{10}(Q) = 2.785 - 0.030657(T-900) + 0.00053144(T-900)^2 - 0.0000074631(T-900)^3,$$

Q being in ° F./second and T being in ° F.; and then uniformly stretching said sheet to effect a permanent set along its length of from about 0.25% to about 1%.

2. The method of claim 1 wherein said quenching of said sheet is at a rate of about Q.

3. The method of claim 1 wherein said stretching of said sheet effects a permanent set along its length of about 0.5%.

4. The method of claim 1 wherein said heating of said sheet is to a temperature T in the range of from about 900° F. to about 950° F.

5. The method of claim 4 wherein said heating of said sheet is from about ½ minute to about 10 minutes in duration.

6. The method of claim 1 wherein said alloy composition consists of up to 0.20% silicon, up to 0.35% iron, up to 0.15% copper, 0.20 to 0.50% manganese, 4.0 to 5.0% magnesium, up to 0.10% chromium, up to 0.25% zinc, up to 0.10% titanium and other elements not exceeding 0.05% each and 0.15% total, balance aluminum.

7. The method of claim 6 wherein said stretching of said sheet effects a permanent set of about 0.5% along its length.

8. The method of claim 7 wherein said heating of said sheet is to a temperature T in the range of from about 900° F. to about 950° F. and is from about ½ minute to about 5 minutes in duration.

9. The method of claim 8 wherein said quenching of said sheet is about Q.

10. Finished sheet as set forth and processed in accordance with claim 1.

11. Finished sheet as set forth and processed in accordance with claim 8.

12. A sheet-metal product formed from the finished sheet set forth in claim 11 wherein at least a portion of the sheet metal product is formed by straining said finished sheet from about ¼% to about 2.5%.

13. An exterior automotive body component, such as a fender or the like, formed from the finished sheet set forth in claim 11 wherein at least a portion of the exterior automotive body component is formed by straining said finished sheet from about ¼% to about 2.5%.

14. The exterior automotive body component of claim 13 at least a portion of which is formed by straining said finished sheet from about ¼% to about 1.5%.

* * * * *